US008709111B2

(12) United States Patent
Felix-Moore et al.

(10) Patent No.: US 8,709,111 B2
(45) Date of Patent: Apr. 29, 2014

(54) FUEL FORMULATIONS

(75) Inventors: Allison Felix-Moore, Chester (GB); George Robert Lee, Chester (GB); Richard John Price, Ince Chester (GB)

(73) Assignee: Shell Oil Company, Houston, TX (US)

( * ) Notice: Subject to any disclaimer, the term of this patent is extended or adjusted under 35 U.S.C. 154(b) by 280 days.

(21) Appl. No.: 12/972,160

(22) Filed: Dec. 17, 2010

(65) Prior Publication Data

US 2011/0154728 A1 Jun. 30, 2011

(30) Foreign Application Priority Data

Dec. 29, 2009 (EP) ..... 09180904

(51) Int. Cl.
*C10L 1/18* (2006.01)

(52) U.S. Cl.
USPC ..... 44/388; 44/385

(58) Field of Classification Search
USPC ..... 44/385, 388
See application file for complete search history.

(56) References Cited

U.S. PATENT DOCUMENTS

| | | | | |
|---|---|---|---|---|
| 2,349,044 | A * | 5/1944 | Jahn | 106/14.27 |
| 6,051,039 | A * | 4/2000 | Sugimoto | 44/341 |
| 6,224,642 | B1 | 5/2001 | Daly et al. | 44/434 |
| 7,473,284 | B2 | 1/2009 | Krull | 44/393 |

FOREIGN PATENT DOCUMENTS

| | | | |
|---|---|---|---|
| WO | WO9704044 | 2/1997 | C10L 1/18 |
| WO | WO 9704044 | 2/1997 | C10L 1/18 |
| WO | WO9821293 | 5/1998 | C10L 1/18 |
| WO | WO 9821293 | 5/1998 | C10L 1/18 |
| WO | WO0118155 | 3/2001 | C10L 1/02 |

OTHER PUBLICATIONS

PCT International Search Report dated Jun. 29, 2011, Application No. PCT/EP2010/070760 filed Dec. 27, 2010.
EPC International Search Report dated Jun. 9, 2010, Application No. 09180904.6-1270.

* cited by examiner

*Primary Examiner* — Cephia D Toomer

(57) ABSTRACT

A diesel fuel formulation with improved lubricity is provided containing (i) a fatty alcohol ester, (ii) an acid-based lubricity additive and (iii) an additional diesel fuel component. The ester (i) has the formula R1-C(O)—O—R2, in which R1 is for example either hydrogen or methyl and R2 is for example a C6 to C14 alkyl group.

22 Claims, No Drawings

FUEL FORMULATIONS

This application claims the benefit of European Application No. 09180904.6 filed Dec. 29, 2009 which is incorporated herein by reference.

FIELD OF THE INVENTION

This invention relates to fuel formulations, their preparation and their use.

BACKGROUND TO THE INVENTION

Modern diesel fuels are typically formulated with low sulphur levels, often 10 ppmw or less, in order to reduce the pollution caused by their combustion. However, the processes used to remove sulphur-containing components also typically reduce fuel lubricity. It is therefore generally necessary to incorporate lubricity enhancing additives in diesel fuels, in particular to reduce wear on the fuel pumps through which the fuels are conveyed.

It is also necessary, both in the interests of the environment and to comply with increasingly stringent regulatory demands, to increase the amount of biofuels used in automotive diesel fuels. Biofuels are combustible fuels, typically derived from biological sources, which result in a reduction in "well-to-wheels" (ie from source to combustion) greenhouse gas emissions. For use in diesel engines, fatty acid methyl esters (FAMEs) such as rapeseed methyl ester, soybean methyl ester and palm oil methyl ester are the biofuels most commonly blended with conventional diesel fuel components.

However, FAMEs and their oxidation products tend to accumulate in engine oil, which has typically limited their use to 10% v/v or less in fuels burned in many diesel engines. At higher concentrations they can also cause fouling of fuel injectors. Moreover, due to the incomplete esterification of oils (triglycerides) during their manufacture, FAMEs can contain trace amounts of glycerides which on cooling can crystallise out before the FAMEs themselves, causing fuel filter blockages and compromising the cold weather operability of fuel formulations containing FAMEs.

It would be desirable to provide new biofuel-containing diesel fuel formulations which could overcome or at least mitigate the above problems, and which ideally could help to overcome lubricity issues in diesel fuels.

SUMMARY OF THE INVENTION

In an embodiment of the present invention, there is provided a diesel fuel formulation containing (i) a fatty alcohol ester, (ii) an acid-based lubricity additive and (iii) an additional diesel fuel component.

DETAILED DESCRIPTION OF THE INVENTION

Fatty alcohol esters have been shown capable of improving the lubricity of diesel fuels. However, they have surprisingly been found to impair the performance of a conventional ester-based lubricity additive such as might be needed in a modern diesel fuel formulation. In contrast, and thus yet more surprisingly, the combination of a fatty alcohol ester and an acid-based lubricity additive has been found capable of improving diesel fuel lubricity to a greater extent than can the additive alone. In other words, the fatty alcohol ester appears capable of enhancing the performance of the acid-based additive, whereas the same interaction does not appear to be present when a fatty alcohol ester is combined with an ester-based lubricity additive. Nor has such an interaction been observed when fatty acid esters are combined with lubricity additives.

Thus, the lubricity modifying effects of a fatty alcohol ester, on a diesel fuel which already contains a lubricity-enhancing additive, appear to be far from predictable. The specific combination of a fatty alcohol ester and an acid-based lubricity additive, has been found to give particular benefits and thus to allow diesel fuels to be formulated with lower additive levels whilst still achieving lubricity values within specification.

In addition to improving the lubricity of a diesel fuel formulation containing an acid-based lubricity additive, and in turn potentially allowing the use of lower additive levels, the invention also allows for an increase in the biofuel content of the formulation but without the above described problems—in particular the build-up of biofuel components in engine oil—which can accompany the incorporation of FAMEs.

A further advantage to using a reverse ester as a biodiesel fuel component, as opposed to a FAME, is that reverse esters can be prepared from fatty alcohols which can in turn be derived from biological sources such as sugars and celluloses. Such crop sources are known to yield a higher fuel energy content per hectare than the crops from which fatty acid esters are derived. Thus, the production and use of reverse esters in place of FAMEs can reduce environmental pressures due to the deforestation of land in order to grow fuel crops or the replacement of much-needed food crops with fuel crops.

A fuel formulation according to the invention should be suitable and/or adapted for use in a compression ignition (diesel) internal combustion engine. It may in particular be an automotive fuel formulation. In further embodiments it may be suitable and/or adapted for use as an industrial gas oil, or as a domestic heating oil.

In the present context, a "fatty alcohol ester" is an ester formed by reacting a fatty alcohol with an acid. Such esters have been termed "reverse esters". They have the formula R1-C(O)—O—R2, where R1 is either hydrogen or hydrocarbyl (typically alkyl or alkenyl) and is typically derived from an acid, and R2 is a hydrocarbyl (typically alkyl or alkenyl) group which is typically derived from a fatty alcohol. An alkyl or alkenyl group may be either straight chain (linear) or branched, in particular straight chain. An alkenyl group will contain one or more, for example either one, two or three, carbon-carbon double bonds.

R1 may for example be either hydrogen or a C1 to C4 alkyl group such as ethyl or in particular methyl.

R2 may for example be a C6 to C14 alkyl or alkenyl group, in particular a C6 to C14 alkyl group. It may be a C6 to C12 alkyl or alkenyl group, in particular a C6 to C12 alkyl group, for example selected from hexyl, octyl, decyl and dodecyl. It may be a C8 to C12 alkyl or alkenyl group, in particular a C8 to C12 alkyl group, for example selected from octyl, decyl and dodecyl. It may be a C10 to C12 alkyl or alkenyl group, in particular a C10 to C12 alkyl group, for example selected from decyl and dodecyl.

In an embodiment, it is a C12 alkyl or alkenyl (in particular alkyl) group.

In an embodiment of the invention, R2 contains an even number of carbon atoms.

A fatty alcohol ester may be prepared by any suitable process, for example by reaction of a fatty alcohol with a suitable acid such as acetic acid or formic acid. The fatty alcohol and/or the acid may be derived from a biological source.

The fuel formulation may contain a mixture of two or more fatty alcohol esters of the type defined above.

The fatty alcohol ester may be included in the fuel formulation at a concentration of 0.5% v/v or greater, or of 1 or 2 or 5% v/v or greater. It may be included at a concentration of up to 55% v/v, or of up to 50 or 45 or 40 or 35% v/v, or of up to 30 or 25 or 20% v/v, for example from 5 to 25% v/v or from 8 to 22% v/v or from 10 to 20% v/v.

The acid-based lubricity additive (ii) is of the type which contains an acid, typically a mono-acid, more typically an organic acid, as its lubricity-enhancing active ingredient. The active ingredient may for example be a carboxylic acid, such as a fatty acid or aromatic acid, in particular the former. Such fatty acids may be saturated or unsaturated (which includes polyunsaturated). They may for example contain from 1 or 2 to 30 carbon atoms, or from 10 to 22 carbon atoms, or from 12 to 22 or from 14 to 20 carbon atoms, or from 16 to 18 carbon atoms, such as 18 carbon atoms. Examples include oleic acid, linoleic acid, linolenic acid, linolic acid, stearic acid, palmitic acid and myristic acid. Of these, oleic, linoleic and linolenic acids may be used, in particular oleic and linoleic acids.

Examples of acid-based lubricity additives are known and commercially available, for example as R650™ (ex Infineum), products in the Lz 539™ series (ex Lubrizol), and ADX4101B™ (ex Adibis). Other conventional lubricity additives for use in diesel fuels tend to contain either ester or amide active ingredients; the former have been found not to yield the benefits of the present invention when combined with fatty alcohol esters in diesel fuels.

In the additive (ii), the acid active ingredient may thus be an organic acid. It may for example be a C16 to C20 organic (typically fatty) acid, such as a C18 fatty acid. In an embodiment of the invention, the additive (ii) is R650™ (ex Infineum).

A fuel formulation according to the invention may contain a mixture of two or more acid-based lubricity additives of the type defined above.

The additive (ii) may be included in the fuel formulation at a concentration of 30 ppmw (parts per million by weight) or greater, or of 50 or 100 or 120 or 150 ppmw or greater. It may be included at a concentration of up to 1000 ppmw, or of up to 500 or 400 or 300 ppmw, or of up to 200 or 100 or 50 ppmw. It may for example be included at a concentration from 50 to 300 ppmw.

The additional diesel fuel component (iii) may be any fuel component suitable for use in a diesel fuel formulation and therefore for combustion within a compression ignition (diesel) engine. It will typically be a liquid hydrocarbon middle distillate fuel, more typically a gas oil. It may be petroleum derived. It may be or contain a kerosene fuel component. Alternatively it may be synthetic: for instance it may be the product of a Fischer-Tropsch condensation. It may be derived from a biological source. It may be or include an oxygenate such as an alcohol (in particular a C1 to C4 or C1 to C3 aliphatic alcohol, more particularly ethanol) or a fatty acid alkyl ester, in particular a fatty acid methyl ester (FAME) such as rapeseed methyl ester or palm oil methyl ester. In an embodiment, however, it may be preferred for the formulation of the invention not to include a fatty acid alkyl ester, in particular a FAME.

An additional fuel component (iii) will typically boil in the range from 150 or 180 to 370° C. (ASTM D86 or EN ISO 3405). It will suitably have a measured cetane number (ASTM D613) of from 40 to 70 or from 40 to 65 or from 51 to 65 or 70.

A formulation according to the invention may contain a mixture of two or more additional diesel fuel components (iii).

The concentration of the component(s) (iii) in the formulation may be 45% v/v or greater, or 50 or 55 or 60% v/v or greater, or 65 or 70 or 75 or 80 or 85 or 90% v/v or greater. It may be up to 99.5% v/v, or up to 99 or 98 or 95% v/v, or up to 90 or 85 or 80% v/v. The component(s) (iii) may represent the major part of the fuel formulation: after inclusion of the fatty alcohol ester (i), the lubricity additive (ii) and any further (optional) fuel additives, the component(s) (iii) may therefore represent the balance to 100%.

The diesel fuel formulation of the invention will suitably comply with applicable current standard diesel fuel specification(s) such as for example EN 590 (for Europe) or ASTM D975 (for the USA). By way of example, the overall formulation may have a density from 820 to 845 kg/m$^3$ at 15° C. (ASTM D4052 or EN ISO 3675); a T95 boiling point (ASTM D86 or EN ISO 3405) of 360° C. or less; a measured cetane number (ASTM D613) of 51 or greater; a kinematic viscosity at 40° C. (ASTM D445 or EN ISO 3104) from 2 to 4.5 centistokes; a sulphur content (ASTM D2622 or EN ISO 20846) of 50 mg/kg or less; and/or a polycyclic aromatic hydrocarbons (PAH) content (IP 391(mod)) of less than 11% w/w. Relevant specifications may however differ from country to country and from year to year, and may depend on the intended use of the formulation. Moreover a formulation according to the invention may contain individual fuel components with properties outside of these ranges, since the properties of an overall blend may differ, often significantly, from those of its individual constituents.

The formulation may have a lubricity such that it gives a HFRR (high friction reciprocating rig) wear scar result, according to the standard test method ISO 12156, of 460 μm or less. This is the current maximum wear scar (ie minimum lubricity) required by the European diesel fuel specification EN 590.

The fuel formulation may contain standard fuel or refinery additives, in particular additives which are suitable for use in automotive diesel fuels. Many such additives are known and commercially available. The formulation may for example contain one or more additives selected from cetane improvers, antistatic additives and cold flow additives. Such additives may be included at a concentration of up to 300 ppmw, for example of from 50 to 300 ppmw.

A process for the preparation of a diesel fuel formulation is provided, which process involves blending together (i) a fatty alcohol ester, (ii) an acid-based lubricity additive and (iii) an additional diesel fuel component, optionally with one or more additional diesel fuel additives. The process may be used to produce at least 1,000 liters of the fuel formulation, or at least 5,000 or 10,000 or 25,000 liters, or at least 50,000 or 75,000 or 100,000 liters.

A method of operating an internal combustion engine, and/or a vehicle which is driven by an internal combustion engine is also provided, which method involves introducing into a combustion chamber of the engine a diesel fuel formulation according to the first aspect of the invention. The engine will suitably be a compression ignition (diesel) engine.

The use of (i) a fatty alcohol ester and (ii) an acid-based lubricity additive, in a diesel fuel formulation, improves the lubricity of the formulation. The formulation may include one or more additional diesel fuel components such as the component (iii) described above.

The lubricity of a fuel formulation can be assessed by any suitable method. One such method involves measuring the wear scar produced on an oscillating ball from contact with a stationary plate whilst immersed in the formulation. This "wear scar" may be measured for example using the test described in Example 1 below.

An "improvement" in the lubricity of a formulation may be manifested for example by a lower degree of wear scar, or of other friction-induced damage, in two relatively-moving components which are exposed to the formulation. The invention may be used to achieve any degree of improvement in the lubricity of the fuel formulation, and/or for the purpose of achieving a desired target lubricity, for example a target set by an applicable current standard such as EN 590.

The concentration of the acid-base lubricity additive in the formulation may be reduced with the use of fatty alcohol ester. Because the fatty alcohol ester has been found to increase the lubricity-enhancing effects of an acid-based additive, its inclusion can mean that such an additive may be used at a lower concentration than might otherwise have been needed in order to achieve a desired target lubricity in the overall fuel formulation. This can in turn reduce the cost and complexity of preparing the formulation, and/or can provide greater versatility in fuel formulation practices.

The use of (i) a fatty alcohol ester and (ii) an acid-based lubricity additive, in a diesel fuel formulation, may reduce the concentration of a second lubricity additive in the formulation.

The term "reducing" embraces any degree of reduction, including reduction to zero. The reduction may for instance be 10% or more of the original concentration of the acid-based lubricity additive or the second lubricity additive, or 25 or 50 or 75 or 90% or more. The reduction may be as compared to the concentration of the relevant lubricity additive which would otherwise have been incorporated into the fuel formulation in order to achieve the properties and performance required and/or desired of it in the context of its intended use. This may for instance be the concentration of the relevant lubricity additive which was present in the formulation prior to the realisation that a fatty alcohol ester (or in the case of the seventh aspect of the invention, a fatty alcohol ester and an acid-based lubricity additive) could be used in the way provided by the present invention, and/or which was present in an otherwise analogous fuel formulation intended (eg marketed) for use in an analogous context, prior to adding a fatty alcohol ester (or a fatty alcohol ester and an acid-based lubricity additive) to it in accordance with the invention.

The reduction in concentration of the relevant lubricity additive may be as compared to the concentration of the relevant additive which would be predicted to be necessary to achieve a desired target lubricity for the formulation in the absence of the fatty alcohol ester and if applicable the acid-based lubricity additive.

The lubricity additive may be any additive which is capable of, or intended to, improve the lubricity of a diesel fuel formulation to which it is added, and/or impart anti-wear effects when such a formulation is used in an engine or other fuel-consuming system. In an embodiment of the seventh aspect of the invention, the second lubricity additive is a lubricity additive other than an acid-based lubricity additive, in particular an additive other than R650™: such additives include ester-based additives, for example R655™ (an ester-based additive ex Infineum), and amide-based additives, for example Hitec™ 4848A (ex Afton). In an embodiment, the second lubricity additive is an ester-based lubricity additive.

An ester-based lubricity additive may contain, as its lubricity-enhancing active ingredient, an ester such as a carboxylic acid ester, in particular a fatty acid ester. Such fatty acids may be as described above in connection with acid-based lubricity additives. An ester-based lubricity additive may alternatively be based on ester-functionalised oligomers or polymers (eg olefin oligomers). Such esters may be mono-alcohol esters such as methyl esters, or more suitably may be polyol esters such as glycerol esters. In an embodiment of the invention, an ester-based lubricity additive contains a mono-, di- or tri-glyceride of a fatty acid, or a mixture of two or more such species.

An amide-based lubricity additive may for example contain, as its lubricity-enhancing active ingredient, a fatty acid amide. The fatty acid element of such an ingredient may be as described above in connection with acid-based lubricity additives. The ingredient may for example be a fatty acid amide of a mono- or in particular di-alkanolamine such as diethanolamine.

Other suitable lubricity enhancers are described for example in:

the paper by Danping Wei and H A Spikes, "The Lubricity of Diesel Fuels", *Wear*, III (1986) 217-235;

WO-A-95/33805—cold flow improvers to enhance lubricity of low sulphur fuels;

WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;

U.S. Pat. No. 5,490,864—certain dithiophosphoric diester-dialcohols as anti-wear lubricity additives for low sulphur diesel fuels; and WO-A-98/01516—certain alkyl aromatic compounds having at least one carboxyl group attached to their aromatic nuclei, to confer anti-wear lubricity effects particularly in low sulphur diesel fuels.

A lubricity additive may contain other ingredients in addition to the key lubricity-enhancing active(s), for example a dehazer and/or an anti-rust agent, as well as conventional solvent(s) and/or excipient(s). Alternatively, a lubricity additive may consist essentially or even entirely of a lubricity-enhancing active, or mixture thereof, of the type described above.

The acid-based lubricity additive may be used, in the fuel formulation, at a concentration below its standard treat rate, due to the additional lubricity-enhancing effects of the fatty alcohol ester. It may for example be used at a concentration of less than 300 ppmw, or of 250 or 200 or 150 ppmw or less, or of 120 ppmw or less, or of 100 ppmw or less, or in cases of 80 or 50 ppmw or less.

In the context of the present invention, "use" of a combination of components (i) and (ii) in a diesel fuel formulation means incorporating the combination into the formulation, typically as a blend (ie a physical mixture) with one or more other fuel components. For this purpose, the fatty alcohol ester and the additive (ii) may be premixed prior to their incorporation into the fuel formulation, or they may be added to the fuel formulation separately. They will conveniently be incorporated before the formulation is introduced into an engine or other system which is to be run on the formulation. Instead or in addition the use of the combination of components (i) and (ii) may involve running a fuel-consuming system, typically an internal combustion engine, on a diesel fuel formulation containing the combination, typically by introducing the formulation into a combustion chamber of an engine.

Similarly, "use" of a fatty alcohol ester in a diesel fuel formulation means incorporating the ester into the formulation, typically as a blend (ie a physical mixture) with one or more other fuel components. The ester will conveniently be incorporated before the formulation is introduced into an engine or other system which is to be run on the formulation. Instead or in addition the use of the fatty alcohol ester may involve running a fuel-consuming system, typically an internal combustion engine, on a diesel fuel formulation containing the ester, typically by introducing the formulation into a combustion chamber of an engine.

In another embodiment, there is provided a diesel fuel formulation containing (a) a fatty alcohol ester and (b) an additional diesel fuel component. The formulation may additionally contain a lubricity additive, for example an acid- or ester-based lubricity additive, more particularly an acid-based lubricity additive.

The fatty alcohol ester (a) may in particular be a C9+ fatty alcohol ester. A C9+ fatty alcohol ester has the formula R1-C(O)—O—R2, where R1 is either hydrogen or hydrocarbyl (typically alkyl or alkenyl) and is derived from an acid, and R2 is a hydrocarbyl (typically alkyl or alkenyl) group having 9 or more carbon atoms and derived from a fatty alcohol. An alkyl or alkenyl group may be either straight chain (linear) or branched, in particular straight chain. An alkenyl group will contain one or more, for example either one, two or three, carbon-carbon double bonds. R1 may for example be either hydrogen or a C1 to C4 alkyl group such as ethyl or in particular methyl. R2—which will typically contain an even number of carbon atoms—may for example be a C9 to C14 alkyl or alkenyl group, in particular a C9 to C14 alkyl group. It may be a C10 to C14 or C10 to C12 alkyl or alkenyl group, in particular a C10 to C14 or C10 to C12 alkyl group. In an embodiment, it is a C11 to C12 alkyl or alkenyl (in particular alkyl) group. In an embodiment, it is a C10 alkyl or alkenyl (in particular alkyl) group. In another embodiment, it is a C12 alkyl or alkenyl (in particular alkyl) group. Thus, in an embodiment the C9+ fatty alcohol ester may be selected from C10 to C12 alkyl esters (such as C10 to C12 alkyl acetates and formates) and mixtures thereof.

The diesel fuel formulation can be prepared in a process by blending together (a) a fatty alcohol ester, in particular a C9+ fatty alcohol ester, and (b) an additional diesel fuel component, optionally with one or more additional diesel fuel additives. A tenth aspect provides a method of operating an internal combustion engine, and/or a vehicle which is driven by an internal combustion engine, which method involves introducing into a combustion chamber of the engine a diesel fuel formulation according to the eighth aspect. An eleventh aspect provides the use of a fatty alcohol ester, in particular a C9+ fatty alcohol ester, in a diesel fuel formulation, for the purpose of improving the lubricity of the formulation. A twelfth aspect provides the use of a fatty alcohol ester, in particular a C9+ fatty alcohol ester, in a diesel fuel formulation, for the purpose of reducing the concentration of a lubricity additive in the formulation.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

The present invention will now be further described with reference to the following non-limiting examples.

EXAMPLE 1

Diesel fuel formulations were prepared by blending a number of C6 to C12 methyl esters, each at both 10% v/v and 20% v/v, with a diesel base fuel DBF. Some of the formulations also contained a commercially available lubricity additive at 150 ppmw, either R650™ or R655™ (both ex Infineum).

The base fuel was a zero sulphur diesel fuel (ex Shell). It did not itself contain any FAMEs or lubricity additives. Apart from its lubricity, the base fuel conformed to the European diesel fuel specification EN 590. Its properties are summarised in Table 1 below.

TABLE 1

| Property | Test method | Value for DBF |
|---|---|---|
| Distillation properties (° C.): | IP 123 | |
| IBP | | 162.1 |
| 10% | | 194.1 |
| 20% | | 209.3 |
| 30% | | 223.3 |
| 40% | | 237.2 |
| 50% | | 252 |
| 60% | | 267.3 |
| 70% | | 283.7 |
| 80% | | 302.1 |
| 90% | | 327.4 |
| 95% | | 349.2 |
| FBP | | 359.9 |
| Rec. at 240° C. (% vol.) | | 42 |
| Rec. at 250° C. (% vol.) | | 48.8 |
| Rec. at 340° C. (% vol.) | | 93.2 |
| Rec. at 345° C. (% vol.) | | 94.2 |
| Rec. at 350° C. (% vol.) | | 95.2 |
| CFPP (° C.) | IP 309 | −20 |
| Cloud point (° C.) | IP 219 | −21 |

The methyl esters tested were methyl hexanoate, methyl octanoate, methyl decanoate and methyl laurate (dodecanoate). All were sourced from Sigma Aldrich.

Of the two additives used, R650™ is an acid-based additive believed to contain an organic mono-fatty acid as its active ingredient. R655™ is an ester-based additive believed to contain a synthetic fatty acid ester as the active ingredient.

The lubricity of each of the prepared formulations, and of the base fuel itself, was then assessed using the following test method, which is a HFRR (high friction reciprocating rig) wear scar test based on ISO 12156. A sample of the fuel or blend under test was placed in a test reservoir which was maintained at a specified test temperature. A fixed steel ball was held in a vertically mounted chuck and forced against a horizontally mounted stationary steel plate with an applied load. The test ball was oscillated at a fixed frequency and stroke length while the interface with the plate was fully immersed in the fluid reservoir. The metallurgies of the ball and plate, and the temperature, load, frequency, and stroke length were as specified in ISO 12156. The ambient conditions during the test were then used to correct the size of the wear scar generated on the test ball to a standard set of ambient conditions, again as per ISO 12156. The corrected wear scar diameter provides a measure of the test fluid lubricity.

The lubricity results are shown in Table 2 below, expressed as fractional wear scar diameters (relative to the EN 590 maximum specification of 460 μm). Each result represents an average (mean) of two readings.

TABLE 2

| Methyl ester | Ester concentration (% v/v) | No additive | R650 ™ (150 ppmw) | R655 ™ (150 ppmw) |
|---|---|---|---|---|
| None (DBF alone) | — | 1.37 | 0.82 | 0.79 |
| Methyl hexanoate | 10 | 1.07 | 0.82 | 0.89 |
| Methyl octanoate | 10 | 0.93 | 0.82 | 0.82 |
| Methyl decanoate | 10 | 0.94 | 0.89 | 0.84 |
| Methyl laurate | 10 | 0.86 | 0.81 | 0.80 |
| Methyl hexanoate | 20 | 0.99 | 0.85 | 0.88 |
| Methyl octanoate | 20 | 0.96 | 0.95 | 0.97 |
| Methyl decanoate | 20 | 0.95 | 0.90 | 0.92 |
| Methyl laurate | 20 | 0.87 | 0.84 | 0.78 |

It can be seen that all of the methyl esters improve the lubricity of the base fuel. Even in the absence of any lubricity additive, 10% v/v or more of a C8 to C12 methyl ester can bring the lubricity of the formulation within the target specification (maximum wear scar diameter of 460 μm, ie fractional wear scar of 1.0 or lower).

In the presence of the acid-based lubricity additive R650™, the test formulations are all still within specification, at both 10 and 20% v/v methyl ester, although the combination of the R650™ and the methyl ester appears to perform less well than the R650™ alone, in particular at 20% v/v methyl ester. A similar effect is observed in the presence of the ester-based additive R655™, the performance of which is impaired by the C6 to C10 methyl esters.

EXAMPLE 2

Example 1 was repeated but using C6 to C12 ethyl esters instead of the methyl esters.

The ethyl esters tested were ethyl hexanoate, ethyl octanoate, ethyl decanoate and ethyl laurate (dodecanoate). All were sourced from Sigma Aldrich.

The lubricity results are shown in Table 3 below, again expressed as fractional wear scar diameters (relative to the EN 590 maximum specification of 460 μm). Each result represents an average (mean) of two readings.

TABLE 3

| Ethyl ester | Ester concentration (% v/v) | No additive | R650 ™ (150 ppmw) | R655 ™ (150 ppmw) |
|---|---|---|---|---|
| None-DBF alone | — | 1.37 | 0.82 | 0.79 |
| Ethyl hexanoate | 10 | 0.95 | 0.93 | 0.87 |
| Ethyl octanoate | 10 | 1.05 | 0.85 | 0.81 |
| Ethyl decanoate | 10 | 0.97 | 0.83 | 0.86 |
| Ethyl laurate | 10 | 0.92 | 0.83 | 0.68 |
| Ethyl hexanoate | 20 | 1.03 | 0.92 | 0.95 |
| Ethyl octanoate | 20 | 1.00 | 0.95 | 0.93 |
| Ethyl decanoate | 20 | 0.97 | 0.90 | 0.94 |
| Ethyl laurate | 20 | 0.86 | 0.89 | 0.80 |

It can be seen from Table 3 that all of the ethyl esters improve the lubricity of the base fuel, although their lubricity enhancing effects are lower than those of the corresponding methyl esters. Even in the absence of lubricity additives, 10% v/v or more of a C10 to C12 ethyl ester can bring the lubricity of the formulation within the target specification.

In the presence of the acid-based lubricity enhancing additive R650™, the test formulations are all still within specification, at both 10 and 20% v/v ethyl ester, although the combination of the R650™ and the ethyl ester gives a poorer lubricity than the R650™ alone. A similar effect is observed in the presence of the ester-based additive R655™, at least for the C6 to C10 ethyl esters.

EXAMPLE 3

Example 1 was repeated but using fatty alcohol esters (reverse esters) instead of the methyl esters.

The reverse esters tested were hexyl acetate, octyl acetate, decyl acetate and dodecyl acetate. All were sourced from Sigma Aldrich.

The lubricity results are shown in Table 4 below, again expressed as fractional wear scar diameters (relative to the EN 590 maximum specification of 460 μm). Each result represents an average (mean) of two readings.

TABLE 4

| Reverse ester | Reverse ester concentration (% v/v) | No additive | R650 ™ (150 ppmw) | R655 ™ (150 ppmw) |
|---|---|---|---|---|
| None-DBF alone | — | 1.37 | 0.82 | 0.79 |
| Hexyl acetate | 10 | 1.29 | 0.74 | 0.84 |
| Octyl acetate | 10 | 1.28 | 0.77 | 1.06 |
| Decyl acetate | 10 | 1.23 | 0.75 | 0.92 |
| Dodecyl acetate | 10 | 1.16 | 0.71 | 0.72 |
| Hexyl acetate | 20 | 1.27 | 0.73 | 1.02 |
| Octyl acetate | 20 | 1.23 | 0.75 | 1.10 |
| Decyl acetate | 20 | 1.28 | 0.78 | 1.04 |
| Dodecyl acetate | 20 | 1.00 | 0.70 | 0.71 |

Table 4 shows that although the reverse esters improve the lubricity of the base fuel, on the whole they are unable to bring the blend within the target specification in the absence of other lubricity additives. Their lubricity enhancing effects are lower than those of the C6 to C12 methyl and ethyl esters tested. Only the dodecyl acetate, at 20% v/v, appears able to improve lubricity to within the target specification, the lubricity enhancing effects of the reverse esters appearing to increase slightly with increasing alkyl chain length.

When a C6 to C10 reverse ester is combined with the ester-based lubricity additive R655™, the result is a reduction in lubricity compared to using the same concentration of R655™ alone, in cases taking the resultant blend outside of the target specification. Again, the dodecyl ester performs better than the others, being the only reverse ester capable of providing an improvement in lubricity when added to a base fuel/R655™ blend.

Surprisingly, however, combining a reverse ester with the acid-based lubricity additive R650™ in all cases improves the lubricity of the base fuel relative to that which can be achieved using R650™ alone. This effect is observed at reverse ester concentrations of both 10 and 20% v/v, and is relatively unaffected by alkyl chain length.

There is therefore a synergistic interaction between the reverse ester and the acid-based lubricity additive, which results in a greater lubricity-enhancing effect. This interaction does not arise between C6 to C10 reverse esters and the ester-based additive R655™. Nor does it arise when the methyl and ethyl esters tested in Examples 1 and 2 are combined with either of the lubricity additives; indeed, the opposite effect is observed in those combinations. The interaction is particularly surprising in view of the inherently poorer lubricity-enhancing properties of the reverse esters alone, when compared with those of the methyl and ethyl esters.

These data show that a reverse ester may be used to improve the lubricity of a diesel base fuel or fuel formulation, in particular in the presence of an acid-based lubricity additive such as R650™. Instead or in addition it may be used to reduce the concentration of lubricity additives necessary in such a fuel or formulation, without or without undue reduction in overall lubricity.

What is claimed is:

1. A diesel fuel formulation comprising a plurality of diesel fuel components comprising (i) a fatty alcohol ester in an amount of 0.5% v/v or greater, (ii) an acid-based lubricity additive and (iii) an additional diesel fuel component.

2. The formulation of claim 1 wherein the fatty alcohol ester (i) has the formula R1-C(O)—O—R2, wherein R1 is either hydrogen or a C1 to C4 alkyl group derived from an acid and R2 is a C6 to C14 alkyl or alkenyl group derived from a fatty alcohol.

3. The formulation of claim 2 wherein R1 is methyl.

4. The formulation of claim 2 wherein R2 is a C6 to C14 alkyl group.

5. The formulation of claim 3 wherein R2 is a C6 to C14 alkyl group.

6. The formulation of claim 4 wherein R2 is a C6 to C12 alkyl group.

7. The formulation of claim 5 wherein R2 is a C8 to C12 alkyl group.

8. The formulation of claim 7 wherein the acid-based lubricity additive comprises a C16 to C20 organic acid.

9. The formulation of claim 1 wherein the fatty alcohol ester is present in an amount up to 55% v/v.

10. The formulation of claim 1 wherein the acid-based lubricity additive is present in an amount of 30 ppmv or greater up to 1000 ppmv.

11. The formulation of claim 1 wherein the acid-based lubricity additive is present in an amount of 30 ppmv or greater up to 1000 ppmv.

12. A process for the preparation of a diesel fuel formulation comprising blending together a plurality of diesel fuel components comprising (i) a fatty alcohol ester in an amount of 0.5% v/v or greater, (ii) an acid-based lubricity additive and (iii) an additional diesel fuel component.

13. A method of operating an internal combustion engine, and/or a vehicle which is driven by an internal combustion engine comprising introducing into a combustion chamber of the engine a diesel fuel formulation of claim 1.

14. A method of operating an internal combustion engine, and/or a vehicle which is driven by an internal combustion engine comprising introducing into a combustion chamber of the engine a diesel fuel formulation of claim 7.

15. The process of claim 12 further comprising further blending with one or more diesel fuel additives.

16. The process of claim 12 wherein the fatty alcohol ester (i) has the formula R1-C(O)—O—R2, wherein R1 is either hydrogen or a C1 to C4 alkyl group derived from an acid and R2 is a C6 to C14 alkyl or alkenyl group derived from a fatty alcohol.

17. The process of claim 12 wherein the acid-based lubricity additive comprises a C16 to C20 organic acid.

18. The process of claim 12 wherein the acid-based lubricity additive is present in an amount of 30 ppmv or greater up to 1000 ppmv.

19. The formulation of claim 1 wherein the fatty alcohol ester is present in an amount of 1% v/v or greater.

20. The process of claim 12 wherein the fatty alcohol ester is present in an amount of 1% v/v or greater.

21. The formulation of claim 1 wherein the fatty alcohol ester is present in an amount of 2% v/v or greater.

22. The process of claim 12 wherein the fatty alcohol ester is present in an amount of 2% v/v or greater.

* * * * *